US009828831B2

(12) United States Patent
Liu et al.

(10) Patent No.: US 9,828,831 B2
(45) Date of Patent: Nov. 28, 2017

(54) BRIDGE TYPE CONCENTRIC CONTINUOUSLY ADJUSTABLE WATER DISTRIBUTOR

(71) Applicant: PETROCHINA COMPANY LIMITED, Beijing (CN)

(72) Inventors: He Liu, Beijing (CN); Xiaohan Pei, Beijing (CN); Fuchao Sun, Beijing (CN); Lichen Zheng, Beijing (CN); Qinghai Yang, Beijing (CN); Yang Gao, Beijing (CN)

(73) Assignee: PETROCHINA COMPANY LIMITED, Beijing (CN)

( * ) Notice: Subject to any disclaimer, the term of this patent is extended or adjusted under 35 U.S.C. 154(b) by 259 days.

(21) Appl. No.: 14/765,191

(22) PCT Filed: Jun. 6, 2013

(86) PCT No.: PCT/CN2013/076856
§ 371 (c)(1),
(2) Date: Jul. 31, 2015

(87) PCT Pub. No.: WO2014/117463
PCT Pub. Date: Aug. 7, 2014

(65) Prior Publication Data

US 2015/0376984 A1 Dec. 31, 2015

(30) Foreign Application Priority Data

Jan. 31, 2013 (CN) ..... 2013 1 0038604

(51) Int. Cl.
*E21B 34/00* (2006.01)
*E21B 34/12* (2006.01)
(Continued)

(52) U.S. Cl.
CPC ..... *E21B 34/12* (2013.01); *E21B 34/14* (2013.01); *E21B 43/20* (2013.01); *E21B 2034/007* (2013.01)

(58) Field of Classification Search
CPC ..... E21B 34/12; E21B 34/14; E21B 43/20; E21B 2034/007
See application file for complete search history.

(56) References Cited

U.S. PATENT DOCUMENTS 3,426,793 A * 2/1969 Alber ..... G05D 7/0126 137/599.06
4,825,895 A 5/1989 Maltman
2006/0175052 A1 8/2006 Tips

FOREIGN PATENT DOCUMENTS

CN 2391009 12/2000
CN 2530037 1/2003
(Continued)

OTHER PUBLICATIONS

First Office Action dated Jan. 27, 2015 for counterpart Chinese Patent Application No. 201310038604.0.
(Continued)

*Primary Examiner* — Yong-Suk Ro
(74) *Attorney, Agent, or Firm* — Loza & Loza, LLP; Michael Fedrick

(57) ABSTRACT

A bridge concentric continuously adjustable water regulator comprising: an outer tube; an adjusting sleeve disposed in the outer tube; a concentric valve connected below the adjusting sleeve, with a center of circle of the concentric valve being concentric to the outer tube; a water outlet which runs through a side wall of the outer tube and is connected to the concentric valve; a lower sealed section which is disposed in the outer tube and is below the concentric valve and the water outlet; and a bridge passage disposed in the
(Continued)

side wall of the outer tube and outside the concentric valve and the lower sealed section.

9 Claims, 2 Drawing Sheets

(51) Int. Cl.
*E21B 43/20* (2006.01)
*E21B 34/14* (2006.01)

(56) References Cited

FOREIGN PATENT DOCUMENTS

| | | |
|---|---|---|
| CN | 2594461 | 12/2003 |
| CN | 2918728 | 7/2007 |
| CN | 201496052 | 6/2010 |
| CN | 102337871 | 2/2012 |
| CN | 202249996 | 5/2012 |
| CN | 203145907 | 8/2013 |

OTHER PUBLICATIONS

Search report dated Jan. 27, 2015 for counterpart Chinese Patent Application No. 201310038604.0.
Search Report dated Feb. 17, 2013 for counterpart Chinese patent application No. 201310038604.0.

* cited by examiner

BRIDGE TYPE CONCENTRIC CONTINUOUSLY ADJUSTABLE WATER DISTRIBUTOR

CROSS-REFERENCE TO RELATED APPLICATIONS

This application is the U.S. national stage of International Patent Application No. PCT/CN2013/076856, filed on Jun. 6, 2013 and entitled BRIDGE-TYPE CONCENTRIC CONTINUOUSLY ADJUSTABLE WATER DISTRIBUTOR, which claims the benefit of priority under 35 U.S.C. §119 from Chinese Patent Application No. 201310038604.0, filed Jan. 31, 2013. The disclosures of the foregoing applications are incorporated herein by reference in their entirety.

TECHNICAL FIELD

The present invention relates to the field of injection and oil production, specifically to a bridge concentric continuously adjustable water regulator, and in particular, to a continuously adjustable water regulator for layered water injection of a high-inclination well.

BACKGROUND ART

In layered water injection of a high-inclination well, when using a conventional eccentric layered water injection process, it is difficult to perform dropping and pulling of a stopper and mating of in-well instruments, making testing and adjusting difficult.

SUMMARY OF THE INVENTION

The present invention provides a bridge concentric continuously adjustable water regulator, to solve the problem in the existing conventional eccentric layered water injection process that it is difficult to perform dropping and pulling of a stopper and mating of in-well instruments in layered water injection of a high-inclination well.

For this reason, the present invention provides a bridge concentric continuously adjustable water regulator, comprising:

an outer tube;

an adjusting sleeve disposed in the outer tube;

a concentric valve connected below the adjusting sleeve, with the center of circle of the concentric valve being concentric to the outer tube;

a water outlet which runs through a side wall of the outer tube and is connected to the concentric valve;

a lower sealed section disposed in the outer tube and located below the concentric valve and the water outlet;

a bridge passage disposed in the side wall of the outer tube and outside the concentric valve and the lower sealed section.

Further, the bridge concentric continuously adjustable water regulator further comprises: a lower joint connected below the outer tube, the lower joint connecting the bridge passage and the lower sealed section.

Further, the outer tube comprises an upper outer tube and a lower outer tube, which are in threaded connection.

Further, the bridge concentric continuously adjustable water regulator further comprises an upper joint connected above the outer tube.

Further, the bridge concentric continuously adjustable water regulator further comprises a locating sleeve disposed in the upper outer tube, the locating sleeve being above the adjusting sleeve.

Further, the adjusting sleeve and the concentric valve are both in the lower outer tube.

Furthermore, the locating sleeve is in the upper outer tube, and an upper end of the locating sleeve has a four-penpoint locating structure which includes four finger-like components that are arranged at intervals and have different heights.

Further, the concentric valve comprises a ceramic valve core and a ceramic valve sleeve that is disposed outside the ceramic valve core, wherein a lower part of the ceramic valve core is provided with a linear V-shaped opening.

Further, there are four water outlets which uniformly run through the side wall of the outer wall, there are sixteen bridge passages in the circumferential direction, and four bridge passages are distributed uniformly between two adjacent water outlets.

Further, the bridge concentric continuously adjustable water regulator further comprises an upper sealed section disposed in the lower outer tube, the upper sealed section connected above the adjusting sleeve and below the locating sleeve.

By taking the advantage of easy mating of concentric tubular columns in high-inclination wells, the present invention provides the bridge passages in the outer tube having a concentric valve so as to provide auxiliary flow passages, so that testing and adjustment of water flooding rate of the current layer will not affect the water flow of a next layer, thereby reducing flow-carrying influence and satisfying the need of single layer testing of the high-inclination well. Meanwhile, the present invention is capable of realizing continuously adjustable and automatic control of single-layer water flooding amount by cooperating with a mated testing and adjusting instrument. The present invention is more applicable to a high-inclination well to realize layered water injection and layered testing, and solve the problem of separate injection testing of the high-inclination well.

DESCRIPTION OF THE NUMBER REFERENCES

1: upper joint; 2: locating sleeve; 3: upper sealed section; 4: adjusting sleeve; 5: (ceramic) valve core; 6: water outlet; 7: (ceramic) valve sleeve; 8: lower sealed section; 9: lower joint; 10: bridge passage; 11: upper outer tube; 12: central passage; 13: lower outer tube; 21: first penpoint; 22: second penpoint; 30: outer tube; 41: spring; 51: V-shaped opening

DETAILED DESCRIPTION OF THE EMBODIMENT

In order to more clearly understand technical features, objects and technical effects of the present invention, a specific embodiment of the present invention is now described with reference to the accompanying drawings.

Figure 1:
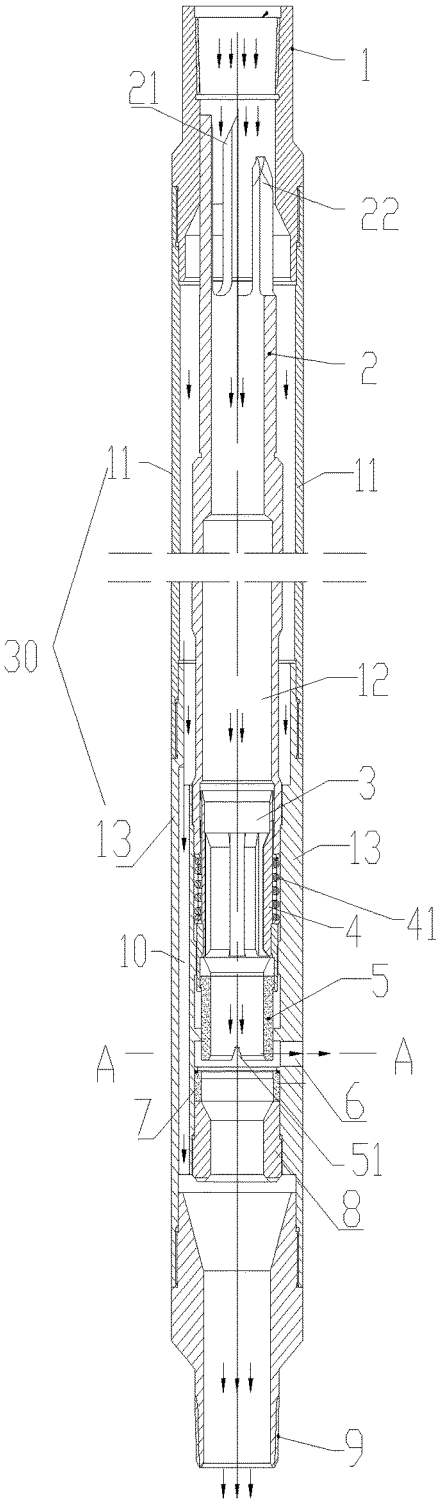
FIG. 1 is a sectional structural schematic of a bridge concentric continuously adjustable water regulator according to an embodiment of the invention. Since the bridge concentric continuously adjustable water regulator is long and thin, part of its length is omitted in the middle part.

As shown in FIG. 1, the bridge concentric continuously adjustable water regulator according to the embodiment of the present invention comprises:

an outer tube 30 which may be an integral structure or may be a sectioned structure, and comprises a central passage 12 for injecting water or for testing. Further, the outer tube comprises an upper outer tube 11 and a lower outer tube 13 that are in threaded connection so as to facilitate manufacturing and installation;

an adjusting sleeve 4 disposed in the outer tube 30, the adjusting sleeve 4 being capable of adjusting a torque and an opening degree of a concentric valve;

the concentric valve connected below the adjusting sleeve 4, with a center of circle of the concentric valve being concentric to the outer tube 30;

a water outlet 6 which runs through a side wall of the outer tube and is connected to the concentric valve;

a lower sealed section 8 which has e.g., a circular tube or circular column circumferential surface having a diameter of 46 mm, is disposed in the outer tube 30 and below the concentric valve and the water outlet 6, and is fitted and sealed with sealing skins of related in-well instruments when measuring single-layer flow rate or in seal-checking;

a bridge passage 10 disposed in the side wall of the outer tube 30 and outside the concentric valve and the lower sealed section 8, for seal-checking and testing. The bridge passage 10 is separated from the water outlet 6 and is not in communication. When measuring single-layer flow rate or in seal-checking, the central passage 12 in the outer tube is communicated with the water outlet 6 at the time of water injection, and water injection fluid of a lower layer flows through by the bridge passage 10 at the time of testing and adjustment, such that testing and adjustment of water injection flow rate of the current layer will not affect the water flow of a next layer, thereby reducing flow-carrying influence and satisfying the need of single layer flow rate testing.

By taking the advantage that tubular columns having concentric valves can be easily mated with the stopper or other in-well instruments in high-inclination wells, the present invention provides the bridge passages in the outer tube having a concentric valve so as to provide auxiliary flow passages, so that testing and adjustment of water flooding rate of the current layer will not affect the water flow of a next layer, thereby reducing flow-carrying influence and satisfying the need of single layer testing of the high-inclination well. Meanwhile, the present invention is capable of realizing continuously adjustable and automatic control of single-layer water flooding amount by cooperating with a mated testing and adjusting instrument. The present invention is more applicable to a high-inclination well to realize layered water injection and layered testing, and solve the problem of separate injection testing of the high-inclination well.

Further, the bridge concentric continuously adjustable water regulator further comprises: a lower joint 9 connected below the outer tube, wherein the lower joint 9 connects the bridge passage 10 and the lower sealed section 8, and the lower joint 9 is a tubular joint and has an inner passage which connects the bridge passage 10 and the lower sealed section 8. The inner passage of the lower joint 9 is connected to the bridge passage 10 so as to be communicated. The lower joint 9 is connected to a lower oil tube for short joint.

Further, as shown in FIG. 1, the outer tube 30 comprises an upper outer tube 11 and a lower outer tube 13 that are in threaded connection. The upper outer tube 11 and the lower outer tube 13 can be the same. Due to the sectional type structure, installation and manufacturing of the bridge concentric continuously adjustable water regulator becomes convenient.

Further, as shown in FIG. 1, the bridge concentric continuously adjustable water regulator further comprises an upper joint 11 connected above the outer tube 30 for connection to an upper oil tube.

Further, as shown in FIG. 1, the bridge concentric continuously adjustable water regulator further comprises a locating sleeve 2 disposed in the upper outer tube 11, the locating sleeve 2 being above the adjusting sleeve 4, for positioning and mating of in-well testing and adjusting instruments by leading in supporting arms thereof. An upper end of the locating sleeve 2 has a four-penpoint locating structure which includes e.g., four finger-like components or paws that are arranged at intervals, and the four finger-like components or paws are disposed on the same cylinder with different heights, e.g., they are disposed on a sleeve barrel of the locating sleeve 2 at intervals. The four-penpoint locating structure is formed into stereoscopic positioning, so as to position and mate the in-well testing and adjusting instruments by rapidly leading in the supporting arms which will not be inclined, for example, as shown in FIG. 1, the first pen point 21 and the second pen point 22 of the four-penpoint locating structure have different heights, and the other two fingers have different heights as well.

Further, the adjusting sleeve 4 and the concentric valve are both in the lower outer tube 13 to facilitate installation. The adjusting sleeve 4 may consist of a cylindrical six-groove adjusting sleeve with adjusting threads at an upper part thereof and a spring 41 and etc., and a lower part of the adjusting sleeve is connected to a valve core of the adjustable concentric valve. Rotation of the adjusting sleeve 3 drives the ceramic valve core 5 to move upward and downward, and concave grooves of the six-groove adjusting sleeve cooperate with the supporting arms of the in-well testing and adjusting instrument to transmit and adjust a torque of the adjustable concentric valve. The spring 41 can ensure that the adjusting threads are kept in an engaged state when the concentric valve is fully opened or fully closed.

Further, the locating sleeve 2 is in the upper outer tube 11 to facilitate installation.

Further, the concentric valve comprises a ceramic valve core 5 and a ceramic valve sleeve 7 that is disposed outside the ceramic valve core. The gap or circular seam between the ceramic valve 5 and the ceramic valve sleeve 7 is adjustable, and forms a passage in communication with the water outlet 6 so as to form a passage for testing and adjusting water injection of the current layer.

A lower part of the ceramic valve core 5 is provided with a V-shaped opening 51. The V-shaped opening 51 is designed according to fluid control principle. Adjustable nozzle flow change and pressure difference are in an approximately linear relationship, and an adjusting variable is relatively small when the opened diameter is small and is relatively large when the opened diameter is large, benefiting water flow adjustment and control and improving on-site testing and adjusting efficiency.

Figure 2:
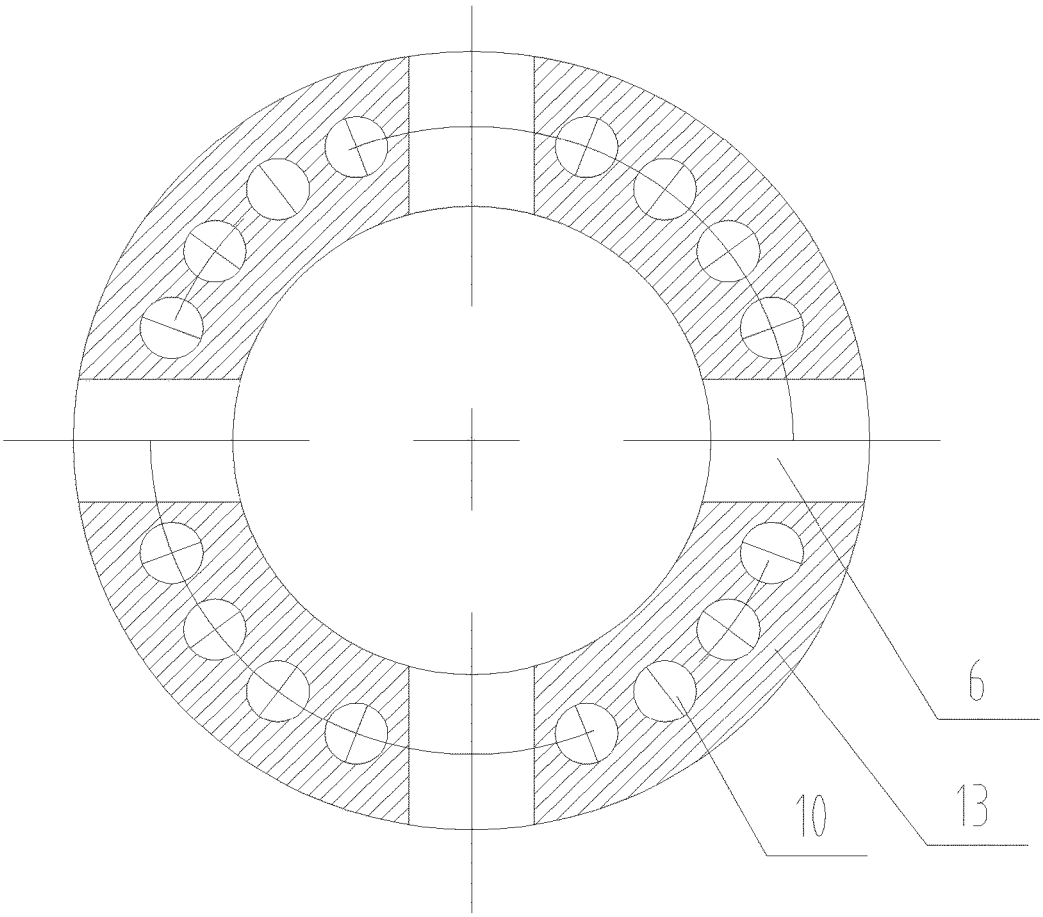
FIG. 2 is an A-A cross-section diagram of FIG. 1, in which the concentric valve is removed, and only side wall of an outer tube as well as water outlets and bridge passages are displayed.

Further, as shown in FIG. 2, there are four water outlets 6 which uniformly run through the side wall of the outer wall 30, there are sixteen bridge passages in the circumferential direction, and four bridge passages 10 are distributed uniformly between two adjacent water outlets. There are multiple water outlets and multiple bridge passages and which are arranged uniformly, the bridge passages are e.g., through holes with a diameter of 9 mm, which can effectively reduce flow-carrying influence and satisfy the need of single layer flow rate testing.

Further, as shown in FIG. 1, the bridge concentric continuously adjustable water regulator further comprises an upper sealed section 3 disposed in the lower outer tube 13, the upper sealed section 3 being connected above the adjusting sleeve 4 and below the locating sleeve 2. The upper sealed section 3 plays sealing and testing roles above the adjusting sleeve 4.

The working process of the present invention can be exemplified as below:

when testing and adjusting water injection rate of the current layer, cooperating with the mated testing and adjusting instrument, placing the testing and adjusting instrument on the locating sleeve 2, an adjusting arm of the testing and adjusting instrument driving the adjusting sleeve 4 to rotate, transmitting a torque so as to drive the concentric valve to rotate to realize change of opening of the concentric valve, meanwhile, sealing skins of the in-well instruments cooperating with the lower sealed section 8 to realize the sealing, at that time, the passage through which the current layer fluid flows passing by the central passage 12, and the current layer fluid flowing from the circular seam between a valve body 5 and the valve core 7 out of the water outlet 6, so as to satisfy the need of single layer flow rate measurement or satisfy the need of the current layer flow rate. At the same time, lower layer water injection fluid flows through the four-penpoint locating structure of the locating sleeve 2 via the central passage 12 into the bridge passage 10 and flows out of the lower joint 9, such that layered testing can be performed in respective independent passages which do not affect each other, so that testing and adjustment of the current layer water injection rate will not affect the water flow of a next layer, thereby reducing flow-carrying influence and satisfying the need of single layer flow rate measurement.

The present invention provides necessary conditions in order to satisfy single-layer testing of bridge concentric layered water injection, so as to realize single-layer direct testing to improve the testing accuracy. By developing a bridge concentric continuously adjustable water regulator and its mated testing and adjusting instrument, it is possible to solve the problem of separate injection testing of a high-inclination well.

The above description is merely a specific schematic embodiment of the present invention, but not intended for limiting the scope of the present invention. The components of the present invention can be combined when they are not conflicted, and equivalent changes and modifications made by persons skilled in the art without departing from structure and principle of the present invention should all pertain to the protection scope of the invention.

The invention claimed is:

1. A bridge concentric continuously adjustable water regulator, comprising:

an outer tube;

an adjusting sleeve disposed in the outer tube;

a concentric valve connected below the adjusting sleeve, with a center of the concentric valve being concentric to the outer tube, wherein the concentric valve comprises a ceramic valve core and a ceramic valve sleeve disposed outside the ceramic valve core, and wherein a lower part of the ceramic valve core is provided with a linear V-shaped opening;

a water outlet which runs through a side wall of the outer tube and is connected to the concentric valve;

a lower sealed section disposed in the outer tube and located below the concentric valve and the water outlet; and a bridge passage disposed in the side wall of the outer tube and outside the concentric valve and the lower sealed section.

2. The bridge concentric continuously adjustable water regulator according to claim 1, further comprising a lower joint connected below the outer tube, wherein the lower joint connects the bridge passage and the lower sealed section.

3. The bridge concentric continuously adjustable water regulator according to claim 1, wherein the outer tube comprises an upper outer tube and a lower outer tube, which are in threaded connection.

4. The bridge concentric continuously adjustable water regulator according to claim 3, further comprising a locating sleeve disposed in the upper outer tube, the locating sleeve being above the adjusting sleeve.

5. The bridge concentric continuously adjustable water regulator according to claim 4, wherein the adjusting sleeve and the concentric valve are both in the lower outer tube.

6. The bridge concentric continuously adjustable water regulator according to claim 4, wherein, the locating sleeve is in the upper outer tube, and an upper end of the locating sleeve has a four-penpoint locating structure which includes four finger-like components that are arranged at intervals and have different heights.

7. The bridge concentric continuously adjustable water regulator according to claim 4, further comprising an upper sealed section disposed in the lower outer tube, the upper sealed section being connected above the adjusting sleeve and below the locating sleeve.

8. The bridge concentric continuously adjustable water regulator according to claim 1, further comprising an upper joint connected above the outer tube.

9. The bridge concentric continuously adjustable water regulator according to claim 1, further comprising four water outlets which uniformly run through the side wall of the outer wall and sixteen bridge passages arranged circumferentially, wherein four bridge passages are distributed uniformly between two adjacent water outlets.

* * * * *